US007464983B1

(12) United States Patent
Acosta et al.

(10) Patent No.: US 7,464,983 B1
(45) Date of Patent: Dec. 16, 2008

(54) CHANGING CURTAIN APPARATUS

(76) Inventors: Lombardo Acosta, 21901 Roscoe Blvd. #8, Canoga Park, CA (US) 91304; Zoila Acosta, 21901 Roscoe Blvd. #8, Canoga Park, CA (US) 91304

( * ) Notice: Subject to any disclaimer, the term of this patent is extended or adjusted under 35 U.S.C. 154(b) by 228 days.

(21) Appl. No.: 11/298,485

(22) Filed: Dec. 12, 2005

(51) Int. Cl.
*B60J 1/20* (2006.01)

(52) U.S. Cl. ..... 296/152; 296/159; 296/1.07; 135/88.15; 135/88.05

(58) Field of Classification Search ..... 296/159, 296/161, 152, 1.07, 160; 4/599, 597, 600; 135/88.13, 88.14, 88.15, 88.16, 88.17, 90, 135/88.05, 88.07
See application file for complete search history.

(56) References Cited

U.S. PATENT DOCUMENTS 1,935,948 A * 11/1933 Hyrup ..... 135/88.13
2,204,432 A 6/1940 Morgadanes
2,926,677 A * 3/1960 Lalonde ..... 135/88.13
3,002,518 A * 10/1961 Maxwell ..... 135/88.13
3,080,568 A * 3/1963 Burnett ..... 4/602
3,365,684 A * 1/1968 Stemke et al. ..... 335/302
4,457,553 A 7/1984 Larkin
D321,292 S 11/1991 Gabriel
D322,520 S 12/1991 Steward et al.
D328,529 S 8/1992 Lenarczyk
5,205,001 A 4/1993 O'Connell
5,790,992 A * 8/1998 Ray ..... 4/599
5,937,452 A * 8/1999 Brewer ..... 4/460
6,840,254 B1 * 1/2005 Windham ..... 135/91
7,231,673 B1 * 6/2007 Arnold et al. ..... 4/599
2002/0179132 A1 * 12/2002 Gutierrez ..... 135/117
2006/0162755 A1 * 7/2006 Platek et al. ..... 135/88.15

* cited by examiner

*Primary Examiner*—Jason S Morrow

(57) ABSTRACT

A changing curtain apparatus includes a flexible peripheral wall having an upper edge and a lower edge. The peripheral wall has a break therein extending between and through an upper edge and a lower edge of the peripheral wall to define an opening into an enclosure defined by the peripheral wall. Each of a plurality of loops is attached to the upper edge. A support extends through the loops and has a pair of free ends each comprising a hook. A vehicle has a plurality of door windows. Each of the hooks is mounted on one of the windows so that the support extends outwardly from the vehicle.

14 Claims, 3 Drawing Sheets

CHANGING CURTAIN APPARATUS

BACKGROUND OF THE INVENTION

1. Field of the Invention

The present invention relates to changing curtain devices and more particularly pertains to a new changing curtain device for attaching to a vehicle so that a person may change their clothes in privacy while at a beach or while exercising.

2. Description of the Prior Art

The use of changing curtain devices is known in the prior art. U.S. Pat. No. 2,204,432 describes a tent assembly that is attachable to a vehicle and which uses the vehicle for support. Another type of changing curtain device is U.S. Pat. No. 5,937,452 which includes a collapsible tent assembly used for providing a bathroom covering. Yet another such device is found in U.S. Pat. No. 4,457,853 which includes a portable shower assembly for attaching to a vehicle which can be slidably extended outwardly from a vehicle.

While these devices fulfill their respective, particular objectives and requirements, the need remains for a device that is collapsible and which may be mounted on the windows of a vehicle to provides a privacy curtain when needed. This will allow for a person to change before or after entering a body of water or before and after exercising.

SUMMARY OF THE INVENTION

The present invention meets the needs presented above by generally comprising a peripheral wall including a flexible material and having an upper edge and a lower edge. The peripheral wall has a break therein extending between and through an upper edge and a lower edge of the peripheral wall to define an opening into an enclosure defined by the peripheral wall. Each of a plurality of loops is attached to the upper edge. A support extends through the loops and has a pair of free ends each comprising a hook. A vehicle has a plurality of door windows. Each of the hooks is mounted on one of the windows so that the support extends outwardly from the vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
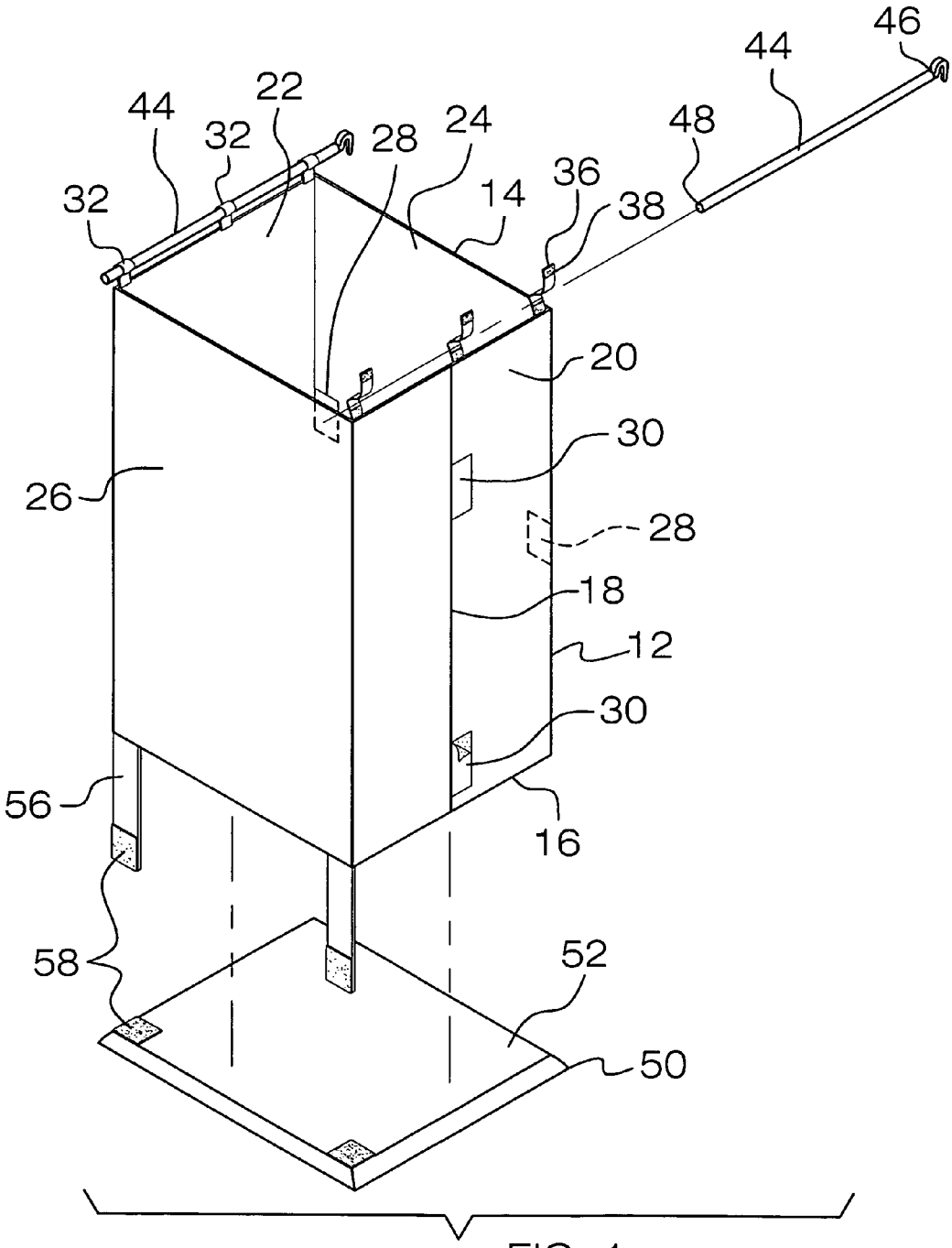
FIG. 1 is a perspective view of a changing curtain apparatus according to the present invention.
Figure 4:
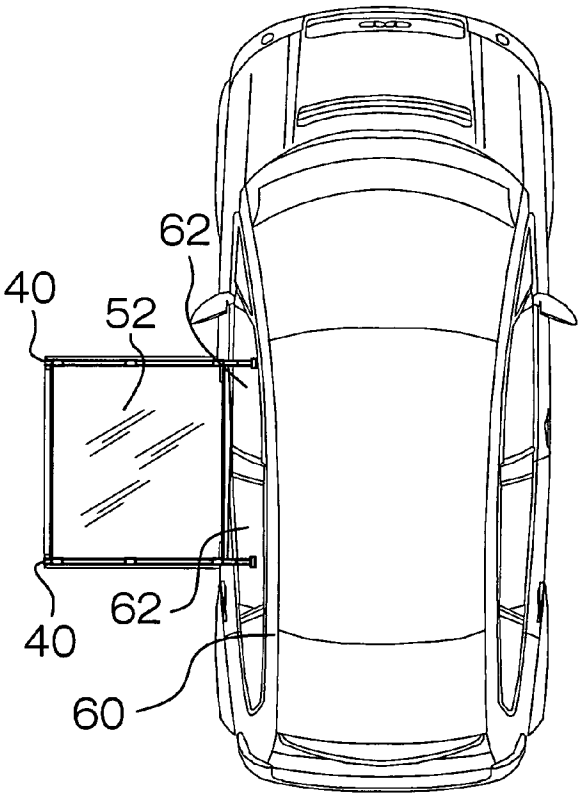
FIG. 4 is a top view of the present invention.
Figure 2:
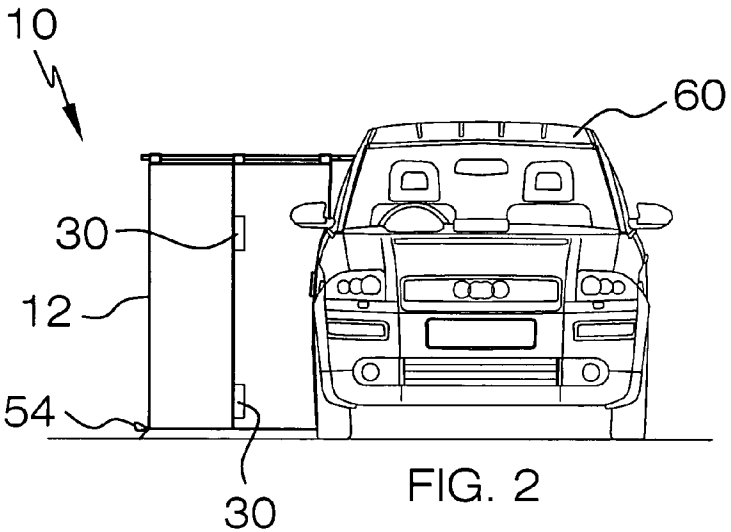
FIG. 2 is a front view of the present invention.
Figure 3:
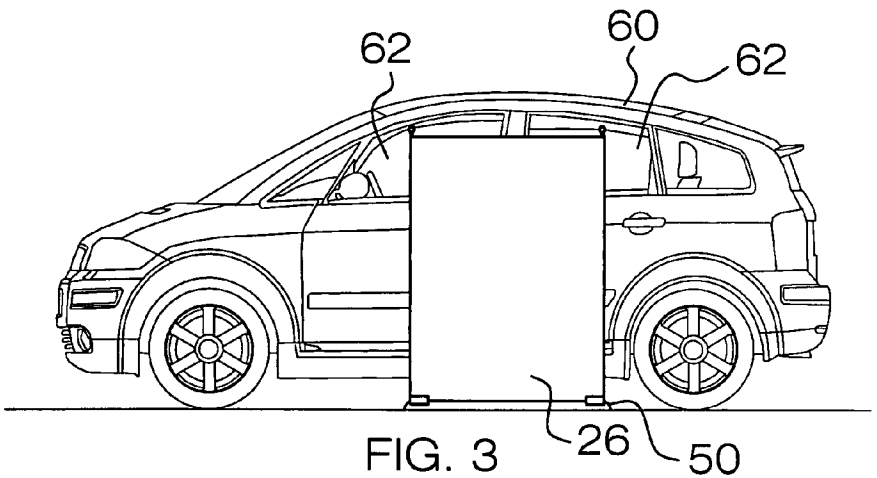
FIG. 3 is a side view of the present invention.
Figure 5:
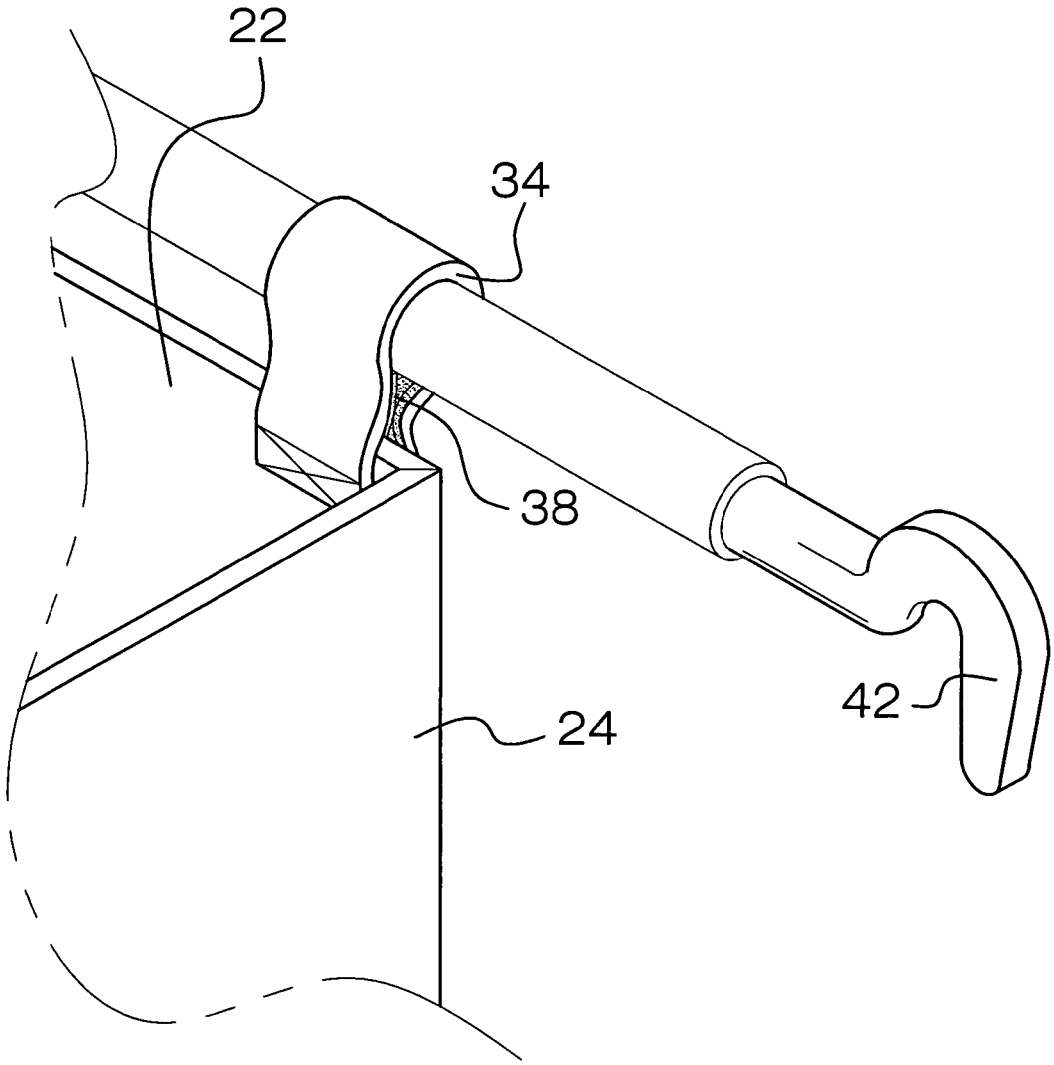
FIG. 5 is an enlarged perspective view of a support assembly of present invention.

With reference now to the drawings, and in particular to FIGS. 1 through 5 thereof, a new changing curtain device embodying the principles and concepts of the present invention and generally designated by the reference numeral 10 will be described.

As best illustrated in FIGS. 1 through 5, the changing curtain apparatus 10 generally comprises a peripheral wall 12 comprised of a flexible material and that has an upper edge 14 and a lower edge 16. The peripheral wall 12 has a break 18 therein extending between and through an upper edge 14 and a lower edge 16 of the peripheral wall 12 to define an opening into an enclosure defined by the peripheral wall 12. The peripheral wall 12 has a height generally between 3 feet and 5 feet. The peripheral wall 12 includes a first wall 20, a second wall 22, a third wall 24 and a fourth wall 26 each attached together. The first 20 and second 22 walls are positioned opposite of each other. The break 18 is positioned in the first wall 20. Each of a plurality of magnets 28 is attached to the peripheral wall 12. The magnets 28 are positioned the third wall 24. Flaps 30 having hook and loop couplers may be used to hold the break 18 in a closed position.

A plurality of loops 32 is provided. Each of the loops 32 is attached to the upper edge 14 of the peripheral wall 12. The loops 32 are positioned on the first 20 and second 22 walls wherein each of the first 20 and second 22 walls has multiple loops attached thereto. Each of the loops 32 comprises an elongated flexible flap 34 having a free end 36 removably attachable to a first side of the flap with a hook and loop coupler 38.

A support 40 extends through the loops 32 and has a pair of free ends each comprising a hook 42. The support 40 comprises a pair of rods 44. Each of the rods 44 has a first end 46 and a second end 48. Each of the first ends 46 comprises one of the hooks 42. A first one of the pair of rods 44 extends along the upper edge 14 of the first wall 20 and a second one of the pair of rods 44 extends along the upper edge 14 of the second wall 22.

A panel 50 has top side 52 and at least one coupler 54 is attached to the peripheral wall 12, adjacent to the bottom edge 16, and is removably coupled to the top side 52 of the panel 50. The top side 52 has a surface area greater than 2.0 square feet and less than 16.0 square fee and acts as a mat for a person to step on. The panel 50 is preferably comprised of a resiliently compressible material. The coupler 54 includes one or more flexible members 56 and a hook and loop coupler 58 for attaching the panel 50 to the peripheral wall 12.

A conventional vehicle 60 has a plurality of door windows 62. Each of the hooks 42 is mounted on one of the windows 62 so that the rods 44 extend outwardly from the vehicle 60. This may be aided by closing the windows 62 to ensure that the hooks 42 are not movable. A person may then use the peripheral wall 12 to shield him or herself while they are changing clothes. The panel 50 is positioned beneath the peripheral wall 12 and may be used to protect the feet of the person while they are changing. The magnets 28 are used for securing the peripheral wall 12 to the vehicle 60 to stabilize the peripheral wall 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A changing curtain assembly comprising:

a peripheral wall comprising a flexible material and having an upper edge and a lower edge, said peripheral wall having a break therein extending between and through an upper edge and a lower edge of said peripheral wall to define an opening into an enclosure defined by said peripheral wall;

a plurality of loops, each of said loops being attached to said upper edge;

a support extending through said loops and having a pair of free ends each comprising a hook;

a panel having top side, at least one coupler being attached to said peripheral wall adjacent to said lower edge and being removably coupled to said top side of said panel; and a vehicle having a plurality of door windows, each of said hooks being mounted on one of said windows wherein said support extends outwardly from said vehicle.

2. The assembly according to claim 1, wherein said peripheral wall has a height generally between 3 feet and 5 feet.

3. The assembly according to claim 1, wherein said peripheral wall includes a first wall, a second wall, a third wall and a fourth wall each being attached together, said first and second walls being positioned opposite of each other, said break being positioned in said first wall.

4. The assembly according to claim 3, wherein said loops are positioned on said first and second walls and each of said first and second walls has multiple loops attached thereto.

5. The assembly according to claim 4, wherein each of said loops comprises an elongated flexible flap having a free end being removably attachable to a first side of said flap.

6. The assembly according to claim 1, wherein each of said loops comprises an elongated flexible flap having a free end being removably attachable to a first side of said flap.

7. The assembly according to claim 4, wherein said support comprises a pair of rods, each of said rods having a first end and a second end, wherein each of said first ends comprises one of said hooks, wherein a first one of said pair of rods extends along said upper edge of said first wall and a second one of said pair of rods extends along said upper edge of said second wall.

8. The assembly according to claim 1, wherein said top side has a surface area greater than 2.0 square feet and less than 16.0 square feet.

9. The assembly according to claim 1, further including a plurality of magnets being mounted on said peripheral wall.

10. The assembly according to claim 4, further including a plurality of magnets being mounted on said peripheral wall, each of said magnets being positioned on said third wall.

11. A changing curtain assembly comprising:

a peripheral wall comprising a flexible material and having an upper edge and a lower edge, said peripheral wall having a break therein extending between and through an upper edge and a lower edge of said peripheral wall to define an opening into an enclosure defined by said peripheral wall, said peripheral wall having a height generally between 3 feet and 5 feet, said peripheral wall including a first wall, a second wall, a third wall and a fourth wall each being attached together, said first and second walls being positioned opposite of each other, said break being positioned in said first wall;

a plurality of magnets being mounted on said peripheral wall, each of said magnets being positioned on said third wall;

a plurality of loops, each of said loops being attached to said upper edge, said loops being positioned on said first and second walls wherein each of said first and second walls has multiple loops attached thereto, each of said loops comprising an elongated flexible flap having a free end being removably attachable to a first side of said flap;

a support extending through said loops and having a pair of free ends each comprising a hook, said support comprising a pair of rods, each of said rods having a first end and a second end, wherein each of said first ends comprises one of said hooks, wherein a first one of said pair of rods extends along said upper edge of said first wall and a second one of said pair of rods extends along said upper edge of said second wall;

a vehicle having a plurality of door windows, each of said hooks being mounted on one of said windows such that said rods extend outwardly from said vehicle; and a panel having top side, at least one coupler being attached to said peripheral wall adjacent to said lower edge and being removably coupled to said top side of said panel, said top side having a surface area greater than 2.0 square feet and less than 16.0 square feet.

12. A changing curtain assembly comprising:

a peripheral wall comprising a flexible material and having an upper edge and a lower edge, said peripheral wall having a break therein extending between and through an upper edge and a lower edge of said peripheral wall to define an opening into an enclosure defined by said peripheral wall, said peripheral wall including a first wall, a second wall, a third wall and a fourth wall each being attached together, said first and second walls being positioned opposite of each other, said break being positioned in said first wall;

a plurality of loops, each of said loops being attached to said upper edge, said loops being positioned on said first and second walls and each of said first and second walls has multiple loops attached thereto;

a support extending through said loops and having a pair of free ends each comprising a hook, said support comprises a pair of rods, each of said rods having a first end and a second end, wherein each of said first ends comprises one of said hooks, wherein a first one of said pair of rods extends along said upper edge of said first wall and a second one of said pair of rods extends along said upper edge of said second wall;

a vehicle having a plurality of door windows, each of said hooks being mounted on one of said windows wherein said support extends outwardly from said vehicle;

a plurality of magnets being mounted on said peripheral wall; and a panel having top side, at least one coupler being attached to said peripheral wall adjacent to said lower edge and being removably coupled to said top side of said panel, said top side having a surface area greater than 2.0 square feet and less than 16.0 square feet.

13. The assembly according to claim 12, wherein said peripheral wall has a height generally between 3 feet and 5 feet.

14. The assembly according to claim 12, wherein each of said loops comprises an elongated flexible flap having a free end being removably attachable to a first side of said flap.

* * * * *